United States Patent [19]

Kirk, Jr.

[11] 4,366,921

[45] Jan. 4, 1983

[54] CHILD-RESISTANT CLOSURE DEVICE

[75] Inventor: Donald C. Kirk, Jr., Midlothian, Va.

[73] Assignee: Ethyl Products Company, Richmond, Va.

[21] Appl. No.: 305,917

[22] Filed: Sep. 28, 1981

[51] Int. Cl.[3] ..... B67B 5/00; B67D 5/32

[52] U.S. Cl. ..... 222/153; 215/221; 215/220; 215/274

[58] Field of Search ..... 215/218, 219, 220, 221, 215/216, 274; 222/153, 380; 239/233

[56] References Cited

U.S. PATENT DOCUMENTS

| | | | |
|---|---|---|---|
| 3,547,295 | 12/1970 | Landen | 215/221 |
| 3,893,582 | 7/1975 | Kowalik | 215/221 |
| 3,971,488 | 7/1976 | McRoskey et al. | 215/274 X |

*Primary Examiner*—George T. Hall

*Attorney, Agent, or Firm*—Donald L. Johnson; John F. Sieberth; E. Donald Mays

[57] ABSTRACT

A child-resistant closure for a container having a threaded cylindrical neck. The container neck is provided with a plurality of outwardly extending ratchet-teeth on its exterior surface below the thread. The cap portion of the closure has a central opening in its top surface that receives the base of the article to be attached to the container neck, e.g. a trigger pump. A collar member is received on the lower end of the closure member and is axially movable thereon. The collar member is provided with a plurality of ratchet-teeth adapted to engage the ratchet-teeth on the neck of the container when the collar is in its lower or down position. The cap has spaced apart splines on its skirt which define recesses that receive inwardly directed lugs provided at the top of the collar. The engagement of the lugs and splines permit the collar to move axially on the cap but prevents separate radial movement between the collar and cap.

12 Claims, 9 Drawing Figures

CHILD-RESISTANT CLOSURE DEVICE

BACKGROUND OF THE INVENTION

Field of the Invention

This invention relates to a child-resistant closure device adapted to attach articles such as hand actuated dispenser pumps to the neck of container.

Federal regulations now require that many products be packaged in containers equipped with child-resistant closures. Examples of such materials are drain cleaners, certain cleaning compositions, disinfectants, insecticides and numerous other products which when injested by children can cause serious injury or death.

Numerous child-resistant closures have been described in the prior art and many of these closures are presently commercially available. Generally, the closures of the prior art which are child-resistant have a solid top-cap portion and are adapted for closure of containers where the cap portion must be completely removed to dispense the contents of the container. One of the early child-resistant and tamper-proof closures is shown in U.S. Pat. No. 2,423,582. The closure system uses a container neck that is provided with a plurality with integrally formed cam shoulders which are engaged by flexible, obliquely directed tongue members on the inner wall of the cap to prevent removal of the cap once the cap is rotated on the closure. To remove the cap, force is applied thereto and weakened vertical sections of the cap's sidewall split open to permit removal of the cap from the container.

Dispensing closures provided with child-proof features are disclosed in U.S. Pat. Nos. 4,209,100 and 4,220,262. These dispensing closures are of the "flip-top" type whereby an opening in the center of the top cap is opened by lifting a flap equipped with a plug member to permit dispensing a stream of the product by squeezing the bottle. These child-resistant closures are permanently engaged with the container to prevent removal therefrom by means of a plurality of peripherally spaced serrations provided on the inwardly facing portion of the lower portion of the skirt of the closure which engage locking serrations provided on the neck of the container. When the closure cap of the above two noted patents are placed on the container it is impossible for either a child or an adult to remove it therefrom without total destruction of the closure, thus preventing reuse of the container.

Other types of safety or child-proof closures which use a combination of ratchets on the neck or shoulder of the container with various types of engaging means on the cap skirt are disclosed in U.S. Pat. Nos. 3,881,623 and 3,891,110.

There are numerous two-piece safety closures where the outer cap normally rotates freely on the inner threaded cap except when the outer cap is pulled upwardly from the inner cap to engage the teeth provided on the inner wall of the outer closure with the teeth on the outer wall of the inner closure to permit engagement and removal of the threaded two piece closure from the container by an adult. One such closure of this type is shown in U.S. Pat. No. 3,977,554. A different type of two-piece child-resistant closure is shown in U.S. Pat. No. 3,912,101 where the outer cap's top portion is provided with legs extending from its underside to maintain the outer cap in the "up" position where it rotates freely when turned by the user. In order to engage the outer and inner caps and remove the inner cap from the container it is necessary to press downwardly on the periphery of the resilient top of the cap so that the lugs on the inner side walls of the outer cap engage the grooves on the outer side wall of the inner cap and rotate the interlocked cap to remove it from the container.

There has been a need in the market place for a child-resistant safety closure which can be utilized to attach hand held dispensing devices such as finger or trigger pumps to a container which would prevent children having access to the contents of the container which may contain fluids harmful to children such as window cleaners, bath tub cleaners, general purpose cleaners, insecticides, etc. Normally, such hand actuated pumps are attached to containers by conventional threaded closure members having a free rotating engagement with the lower end of the pump and a threaded engagement with the conventional threads of the container. These types of closure attachments can be removed by young children.

Certain hand actuated pumps utilized on commercial products now on the market have a permanently placed loose fitting collar or sleeve attached to the container after the dispenser pump is coupled to the container by means of the conventional closure. The free-rotating sleeve prevents removal of the closure attachment by both children and adults after the container has been filled and the sleeve has been attached thereto. Thus the container and pump cannot be reused after original contents have been used up.

Thus it can be seen that there is a need in the market place for a child-resistant closure member for attaching a device such as a trigger pump or finger pump to a container which closure member can be removed by an adult for refilling of the container yet will prevent a child from opening the container and possibly injesting the contents thereof.

SUMMARY OF THE INVENTION

It is an object of the present invention to provide a child-resistant closure assembly for a container.

It is another object of the present invention to provide a child-resistant closure assembly for removably attaching an article to a container.

It is also an object of the present invention to provide an economical child-resistant closure for a container.

It is another object of the present invention to provide a child-resistant closure assembly for attaching a dispensing device to a container.

The foregoing objects are achieved in a child-resistant closure for a container wherein the container has a cylindrical neck with a thread provided on its outer surface. The container neck is provided with a plurality of ratchet-teeth on its exterior surface. The closure member has a central opening in its top surface and is provided with a thread on the interior surface of its cylindrical skirt. A collar member is received on the lower end of the closure member and is axially movable thereon. The collar member is provided with a plurality of ratchet-teeth adapted to engage the ratchet-teeth on the neck of the container when the collar is in the lower position. Both the collar and the closure are provided with engaging means which permit limited axial movement of the collar on the closure but prevents radial movement of the collar without corresponding radial movement of the closure.

The child-resistant closure of the present invention is particularly adapted for connecting dispensing devices such as finger-actuated sprayers or dispensers to hand held containers. Dispensers such as finger actuated pumps and trigger actuated pumps can be attached to the neck of small containers with the closure of the present invention to provide a child-resistant closure. The closure can be readily opened by an adult to permit refilling of the container whereby the pump-container combination can be reused many times.

Other objects and advantages of the present invention will be more readily apparent from a further consideration of the following detailed description of the drawings and the preferred embodiments of the invention.

DESCRIPTION OF THE PREFERRED EMBODIMENTS

Figure 8:
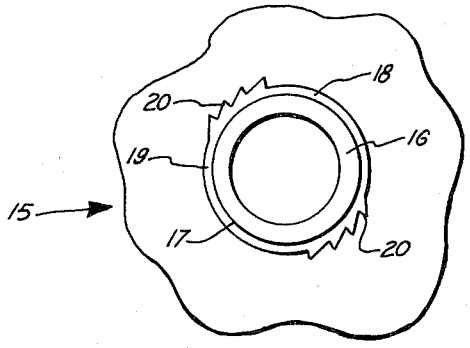
FIG. 8 is a top view of a bottle container, with the bottle shown in broken section, and also showing the ratchet-teeth on the neck of the container.
Figure 9:
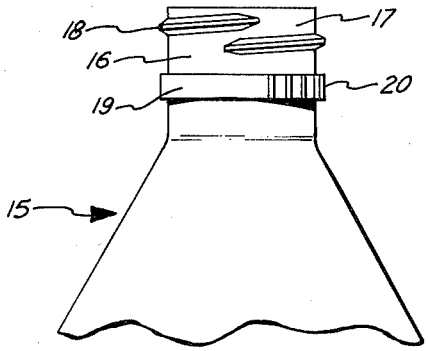
FIG. 9 is an elevational view of the bottle container neck of FIG. 8.

Referring now to FIGS. 1, 2, 8 and 9 the container utilized in conjunction with the present child-resistant closure is a bottle designated generally by the numeral 15. The bottle is provided with a generally cylindrical, upstanding neck portion 16. The exterior wall 17 of the neck 16 is provided with spiral thread 18 as best seen in FIG. 9. While the thread 18 shown in the drawings as a continuous thread is understood that the thread can be an interrupted or lug type thread if so desired. Spaced below the thread 18 on the neck is an integrally formed annular ring 19 extending radially outwardly from the neck 17. The ring 19 is provided with two sets of integrally formed ratchet-teeth 20. While the ratchet-teeth shown in FIG. 8 are composed of two opposed sets of teeth, it is understood that the ratchet-teeth maybe continuous around the exterior surface of the ring 19.

Figure 2:
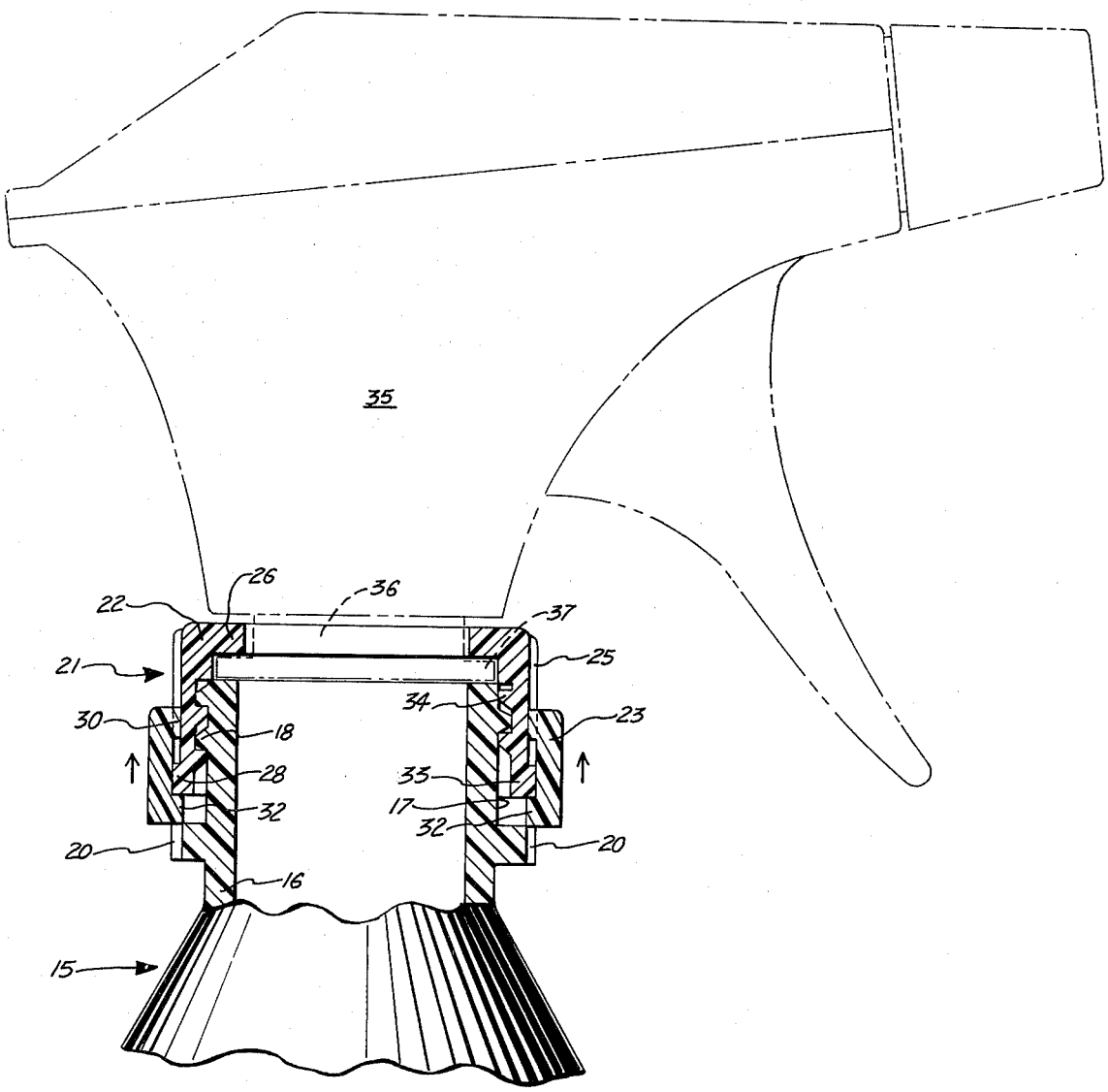
FIG. 2 is a view similar to FIG. 1 showing the collar of the child-resistant closure in the "up" position whereby the closure can be removed from the container.
Figure 3:
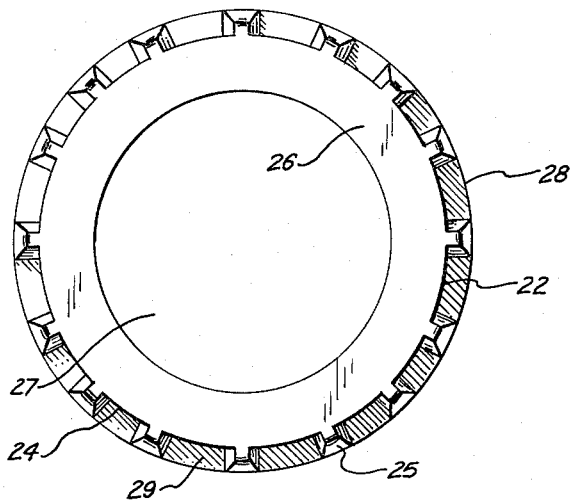
FIG. 3 is a top view of the closure member.
Figure 4:
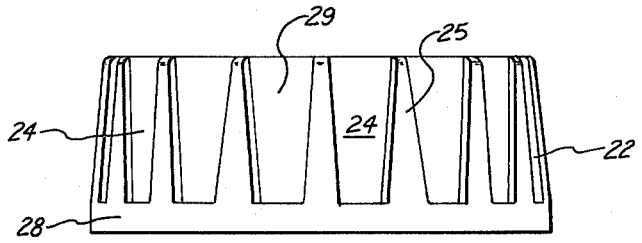
FIG. 4 is an elevational view of the closure member.
Figure 5:
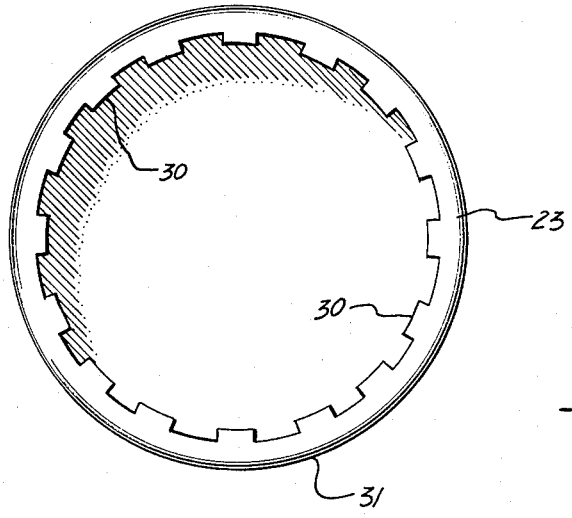
FIG. 5 is the top view of the collar.
Figure 6:
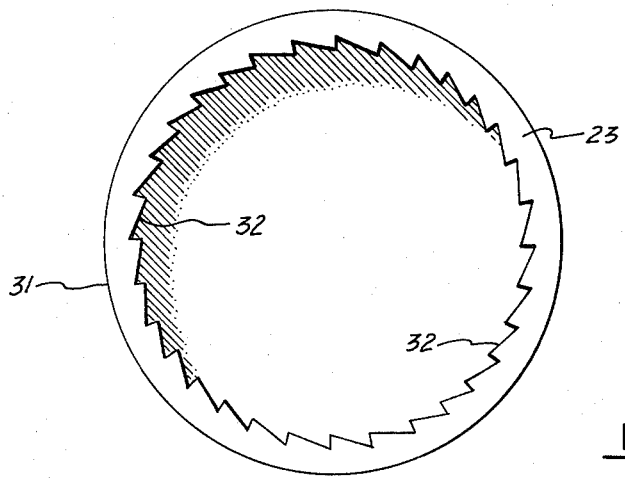
FIG. 6 is a bottom view of the collar.
Figure 7:
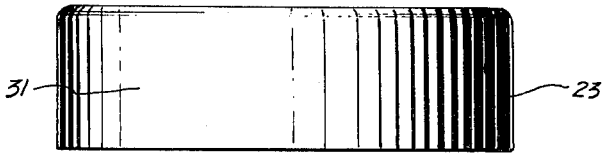
FIG. 7 is an elevational view of the collar.

The child-resistant closure assembly, designated generally by the numeral 21, includes the closure member 22 as seen in FIGS. 3 and 4, and the collar member 23 as seen in FIGS. 5–7. The collar member 23 is retained on the lower end of the closure member 22 and is axially movable up and down as seen in FIGS. 1 and 2.

As seen more clearly in FIGS. 3 and 4 the closure member 22 has a depending skirt portion 24 which is provided with a plurality of slightly upward tapered, spaced apart splines 25 on its exterior surface. Adjacent splines define a plurality of upwardly opening tapered recesses 29 in the skirt 24 of the closure member. The top surface 26 of the closure is provided with a large central opening 27. The lower end of the closure is provided with an annular band 28 from which the splines 25 project upwardly.

Figure 1:
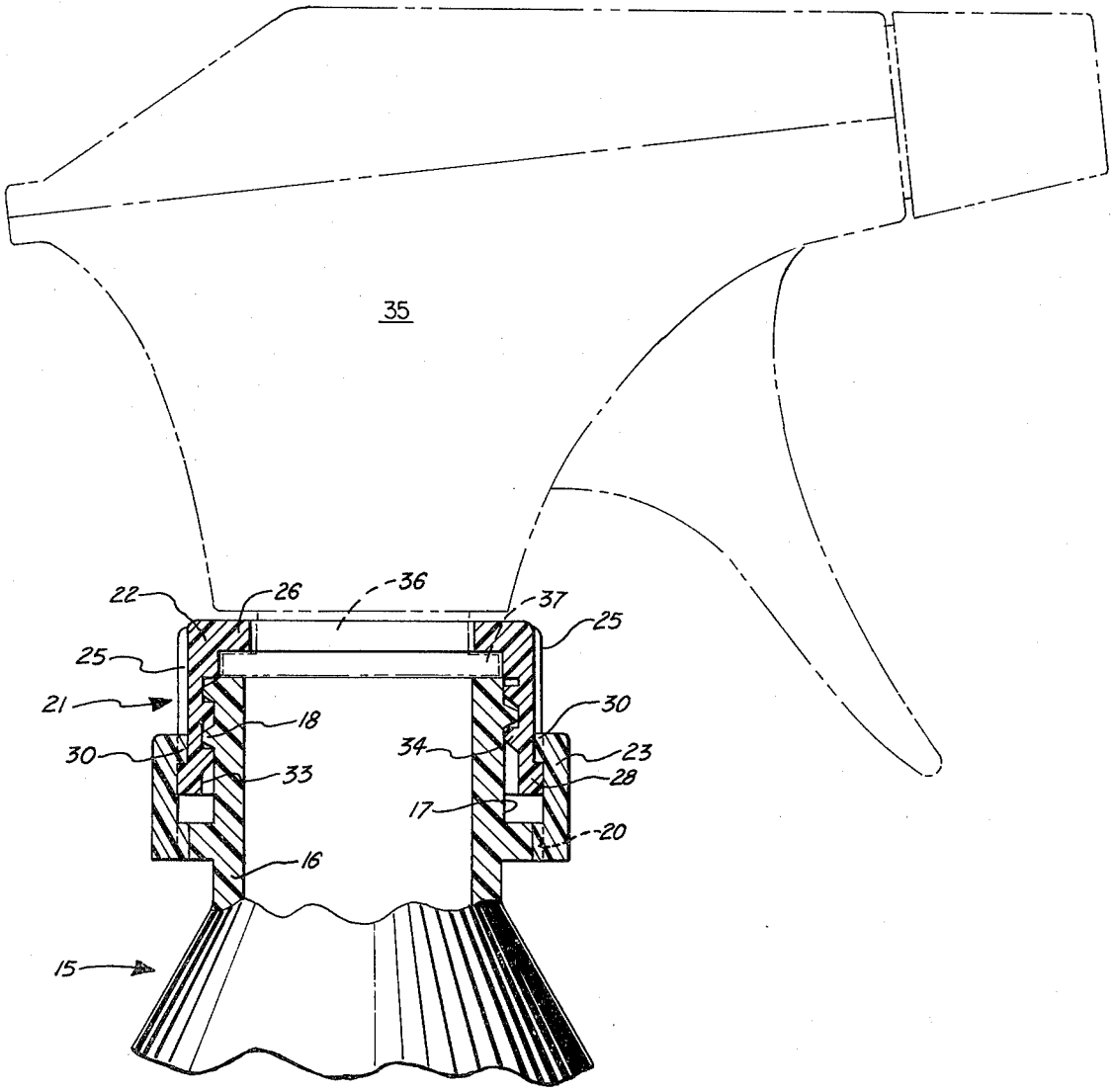
FIG. 1 is an elevation view of the child-resistant closure of the present invention, portions being shown in broken section, with the closure retaining a trigger pump dispenser shown in dotted outline.

Referring now in particular to FIGS. 5, 6 and 7 the collar member 23 of the closure assembly 21 is provided with a series of radial inwardly extending rectangular lugs 30 on its upper surface as seen in FIGS. 1 and 2. These lugs are adapted to be received in the recesses 29 between adjacent spline members to permit the collar to be axially movable on the closure member while being rotatively coupled thereto. The collar member 23 is provided with a cylindrical skirt 31 having a plurality of serrations therein to provide a good grip by the fingers of the user. The lower end of the skirt 31 is provided with a plurality of inwardly projecting ratchet-teeth members 32. These teeth members are uniformly spaced around the inside of the lower end of the collar 23 and are adapted to engage the corresponding ratchet-teeth members 20 on the neck 16 of the container to lock the collar member thereto.

As seen in FIGS. 1 and 2 the child-resistant closure assembly 21 of the present invention is preferably formed by injection molding from thermo-plastic material the closure member 22 and the collar member 23. These members are subsequently assembled by placing the collar member 23 over the closure member 25 and pressing the collar member down until the ratchet-teeth 32 on the collar member snap over the annular band 28 at the lower end of the closure member thereby permanently attaching the collar member to the lower portion of the closure member.

As seen in FIG. 1, the interior wall 33 of the closure member 22 is provided with an interior spiral thread 34 which engages the spiral thread 18 on the outer wall of the neck portion 16 of the container to firmly attach the closure to the neck of the container.

When the closure member and collar member have been assembled as described hereinbefore the child-resistant closure assembly can then be attached to the threaded neck of the container by moving the collar 23 into the "up" position shown in FIG. 2, gripping the knurled periphery of the collar member 23 and rotatably attaching the closure assembly to the neck of the container. When the closure assembly is in the position shown in FIG. 2 the lugs on the collar member are received between adjacent spline members 25—25 on the closure and by this engagement rotate the closure member and its threaded co-action with the threads on the container neck until the closure member is firmly fitted on the neck of the container. After the seal has been established the collar member is pressed downwardly which results in engagement of the ratchet-teeth 32 on the collar member with the ratchet-teeth 20 on the container neck. Once engagement is achieved between the teeth 20–32 it is impossible to remove the closure assembly from the container 15 until the collar 23 is pulled into its "up" position to disengage the interlocked ratchet-teeth.

The dimension tolerance between the width of the lugs 30 and the distance separating the spline member 25—25 is carefully controlled to provide a very tight fit when the lug member 30 is at the lowest portion of the tapered recess 29. This provides a tight engagement between the closure and the collar which resists upward movement of the collar by a child, yet readily permits an adult to move the lugs upwardly in the tapered recesses in order to disengage the co-engaged ratchet-teeth 20 on the container neck with the ratchet-teeth 32 on the collar. The ratchet-teeth on the collar extend inwardly a sufficient distance to engage the bottom of the ring 28 and thus prevent the collar 23 from being inadvertently pulled off the closure member.

While the closure assembly of the present invention can be used on any number of containers for attaching various devices thereto e.g., flexible conduits for emptying the container, spray or stream dispenser nozzles, finger pump or trigger pump dispensers etc., the invention has particular use for adapting trigger pumps or finger pump dispensers for attachment to containers of products which might be poisonous to children.

In FIGS. 1 and 2 of the drawings, the child-resistant closure assembly 21 in the present invention is shown as being utilized to attach a trigger pump dispenser, designated generally by the numeral 35 and shown in phantom, to the container 15. The trigger pump 35 may be that type shown in U.S. Pat. Nos. 4,161,288 and 4,227,650, or it may be any other type of commercial trigger pump available on the present market. Also finger pumps of the type shown in U.S. Pat. No. 3,159,316 may utilize the closure assembly of the present invention. In the embodiment of the closure assembly of the present invention shown in FIGS. 1 and 2 the trigger pump 35 has an attachment member 36 fixedly attached by welding or glue or other means to the body of the pump 35. Attachement member 36 has an annular ring portion 37 which is sealingly received between the underside of the top 26 of the closure member and the lip of the container 15 to provide a leak-proof seal.

Containers for many products can be rendered child-resistant by utilizing the closure assembly of the present invention. An additional feature of the present invention not found in child-resistant closures of the prior art is the ability of the child-resistant closure assembly to be released from the container by an adult to permit refilling of the container with the same or a different product for further utilization of the container and the dispenser pump. As noted previously many child-resistant closures presently utilized for attaching devices to containers fixedly lock the closure and dispensing device to the top of the container thus prohibiting reuse of either the container or the dispensing device for dispensing additional quantities of the original materials in the container or other materials as may be desired.

The invention has been described in the preferred embodiment but should not be limited to that described and illustrated, it being understood that modifications may be made thereto which are within the ability of those skilled in the art and that the invention described herein should be limited only by the scope of the claims contained herein.

What is claimed is:

1. A child-resistant closure for attaching a dispensing device to a container including:

(a) a container having a cylindrical neck, with a thread provided on its outer surface, (b) a plurality of ratchet-teeth located on said neck below said thread, (c) a closure member provided with a central opening in its top surface and having a cylindrical skirt that is provided with a thread on its interior surface; said closure member being coupled to said dispensing device;

(d) a collar member received on the lower end of said closure member and being axially movable thereon, said collar member being provided with a plurality of ratchet-teeth adapted to engage said ratchet-teeth on said neck when said collar is in its lowermost position; and (e) engaging means on said collar and on said closure whereby said collar can be moved axially on said closure but cannot be moved radially with respect thereto.

2. A child-resistant closure of claim 1, wherein the engaging means on said collar comprises a plurality of inwardly directed lugs at the upper end of said collar and said engaging means on said closure including spaced apart ribs on the side wall of said closure that define recesses to slidingly receive said inwardly extending lugs on said collar.

3. The child-resistant closure of claim 1, wherein said collar is provided with said ratchet-teeth which are extended inwardly whereby they engage the lower edge of the closure member to prevent said collar from being easily removed from said closure.

4. The child-resistant closure of claim 3 wherein said collar has a depth less than the depth of the skirt portion of said closure whereby said collar is retained on said closure.

5. The child-resistant closure of claim 1, wherein a plurality of ratchet-teeth located on said neck of said container comprises two sets of opposed ratchet-teeth, and wherein said ratchet-teeth on the lower end of said collar are continuous around the inner lower periphery of said collar.

6. A child-resistant closure for a container having a thread on the neck thereof comprising;

(a) a closure member having a top with a central opening therein and an integral skirt member depending therefrom, said skirt member being provided with a thread on the interior wall of said skirt;

(b) a collar member received on the lower end of the closure member and being axially movable thereon, said collar being provided with a plurality of inwardly facing ratchet-teeth on its lower periphery, said ratchet-teeth being adapted to engage similar ratchet-teeth provided on the neck of a container; and (c) a plurality of spaced apart vertically extending spline members on the outer wall of the skirt of the closure;

(d) a plurality of inwardly facing lug members at the upper end of said collar member, said lug members adapted to engage the spaces between said spline members that permit vertical movement of said collar on said closure while preventing radial movement thereon.

7. The child-resistant closure of claim 6, wherein the under surface of the top of said closure is provided with an annular recess adjacent said opening adapted to receive an annular collar portion provided on a device to be attached to a container to position said annular portion on the neck of such container.

8. The child-resistant closure of claim 7, wherein said article to be positioned on said container is a finger-actuated dispensing device.

9. The child-resistant closure of claim 8, wherein said finger-actuated dispensing device is a trigger pump.

10. The child-resistant closure of claim 6, wherein said closure and said collar are made of plastic material.

11. The child-resistant closure of claim 6, wherein said closure member is provided with an exterior annular ring portion adjacent its lower end and said collar member is provided with inwardly facing lug members having a diameter between opposite lug members which is smaller than the diameter of said annular ring whereby said collar is retained on said closure by engagement of said lug with said ring portion of said collar, once the collar is placed on said closure.

12. The child-resistant closure of claim 6, wherein said collar member is provided with a serrated exterior cylindrical surface whereby said collar can be readily rotated to attach said closure to a container.

* * * * *